US010435978B2

(12) United States Patent
Corbeil

(10) Patent No.: US 10,435,978 B2
(45) Date of Patent: Oct. 8, 2019

(54) ATMOSPHERIC BALL INJECTING APPARATUS, SYSTEM AND METHOD FOR WELLBORE OPERATIONS

(71) Applicant: GE OIL & GAS CANADA INC., Houston, TX (US)

(72) Inventor: Jason Corbeil, Bentley (CA)

(73) Assignee: GE OIL AND GAS CANADA INC., Houston, TX (US)

( * ) Notice: Subject to any disclaimer, the term of this patent is extended or adjusted under 35 U.S.C. 154(b) by 793 days.

(21) Appl. No.: 14/298,817

(22) Filed: Jun. 6, 2014

(65) Prior Publication Data

US 2014/0360720 A1 Dec. 11, 2014

Related U.S. Application Data

(60) Provisional application No. 61/832,911, filed on Jun. 9, 2013.

(30) Foreign Application Priority Data

Jun. 7, 2013 (CA) ..... 2818250

(51) Int. Cl.
*E21B 33/068* (2006.01)

(52) U.S. Cl.
CPC ..... *E21B 33/068* (2013.01)

(58) Field of Classification Search
CPC ..... E21B 33/13; E21B 33/068
USPC ..... 166/75.15
See application file for complete search history.

(56) References Cited

U.S. PATENT DOCUMENTS

| | | | |
|---|---|---|---|
| 2,615,519 | A | 10/1952 | Carr |
| 2,965,125 | A | 12/1960 | Osborne et al. |
| 3,011,196 | A | 12/1961 | Glover |
| 3,148,689 | A | 9/1964 | Bean |
| 3,166,094 | A | 1/1965 | Eagleton |

(Continued)

FOREIGN PATENT DOCUMENTS

| | | |
|---|---|---|
| CA | 2703426 | 11/2010 |
| CA | 2746598 | 1/2013 |

(Continued)

OTHER PUBLICATIONS

Canadian Search Report issued in connection with corresponding CA Application No. 2818250 dated Jun. 27, 2016.

(Continued)

*Primary Examiner* — William D Hutton, Jr.
*Assistant Examiner* — Steven A MacDonald
(74) *Attorney, Agent, or Firm* — Hogan Lovells US LLP

(57) ABSTRACT

In one aspect the invention provides a ball injecting apparatus for releasing balls into the wellbore of a well. The apparatus comprises a body having an interior capable of housing one or more balls, at least one window in the body to allow for fluid communication between the body's interior and outside atmosphere. The window also provides for placement and removal of the balls into and out of the body's interior. An opening of suitable dimensions is provided on the body to allow the balls to exit the apparatus. A ball retaining and release mechanism retains and selectively releases the balls out the opening. The interior of the ball injecting apparatus is open to atmospheric pressure during operations. System and method aspects are also provided.

9 Claims, 15 Drawing Sheets

(56) References Cited

U.S. PATENT DOCUMENTS

| | | | |
|---|---|---|---|
| 3,169,263 | A | 2/1965 | Eagleton |
| 3,218,659 | A | 11/1965 | Rowley |
| 3,266,077 | A | 8/1966 | Elliott |
| 3,322,197 | A | 5/1967 | Baker |
| 3,408,674 | A | 11/1968 | Hogan |
| 3,678,730 | A | 7/1972 | Barrett, Jr. |
| 3,779,270 | A | 12/1973 | Davis |
| 4,016,621 | A | 4/1977 | Slegers |
| 4,073,303 | A | 2/1978 | Foley |
| 4,132,243 | A | 1/1979 | Kuus |
| 4,268,932 | A | 5/1981 | Hogan |
| 4,351,079 | A | 9/1982 | Fitzpatrick |
| 4,359,797 | A | 11/1982 | Banks |
| 4,361,446 | A | 11/1982 | Hogan |
| 4,401,133 | A | 8/1983 | Lankston |
| 4,427,065 | A | 1/1984 | Watson |
| 4,435,872 | A | 3/1984 | Leikam |
| 4,457,037 | A | 7/1984 | Rylander |
| 4,586,529 | A | 5/1986 | Mocquart |
| 4,709,719 | A | 12/1987 | Littleton |
| 4,736,482 | A | 4/1988 | Lankston |
| 4,782,894 | A | 11/1988 | LaFleur |
| 5,095,988 | A | 3/1992 | Bode |
| 5,139,576 | A | 8/1992 | Davis |
| 5,186,757 | A | 2/1993 | Abney, Sr. |
| 5,884,656 | A | 3/1999 | Smith |
| 5,890,537 | A | 4/1999 | Lavaure |
| 5,913,637 | A | 6/1999 | Rajabali |
| 6,428,241 | B1 | 8/2002 | Stracke |
| 6,769,152 | B1 | 8/2004 | Crenshaw |
| 7,552,763 | B2 | 6/2009 | Claxton |
| 7,571,773 | B1 | 8/2009 | West |
| 8,091,628 | B2 | 1/2012 | Peer |
| 8,136,585 | B2 | 3/2012 | Cherewyk |
| 8,256,514 | B2 | 9/2012 | Winzer |
| 8,561,684 | B2 | 10/2013 | Winzer |
| 8,640,293 | B2 | 2/2014 | Nelson et al. |
| 8,869,882 | B2 | 10/2014 | McGuire et al. |
| 8,869,883 | B2 | 10/2014 | McGuire et al. |
| 9,101,413 | B2 | 8/2015 | Masson et al. |
| 9,103,183 | B2 | 8/2015 | He et al. |
| 9,109,422 | B2 | 8/2015 | Ferguson et al. |
| 2008/0223587 | A1 | 9/2008 | Cherewyk |
| 2010/0200222 | A1 | 8/2010 | Robichaux |
| 2010/0288496 | A1 | 11/2010 | Cherewyk |
| 2010/0294511 | A1 | 11/2010 | Winzer |
| 2012/0234534 | A1 | 9/2012 | Hughes et al. |
| 2013/0014936 | A1* | 1/2013 | Griffith ..... E21B 33/068 166/75.15 |
| 2013/0032327 | A1 | 2/2013 | He et al. |
| 2013/0228326 | A1 | 9/2013 | Griffith |
| 2014/0102717 | A1 | 4/2014 | Cherewyk |
| 2014/0196883 | A1 | 7/2014 | Artherholt |
| 2015/0021024 | A1 | 1/2015 | Artherholt et al. |

FOREIGN PATENT DOCUMENTS

| | | |
|---|---|---|
| CN | 201460815 | 5/2010 |
| CN | 102921686 | 2/2013 |

OTHER PUBLICATIONS

Reexamination decision dated May 3, 2018 in corresponding Canadian Patent. No. 2,818,250.

Reexamination Decision dated Jan. 7, 2019 in corresponding Canadian Patent No. 2,818,250.

Office Letter and Reexamination Certificate of Jul. 26, 2019 in corresponding Canadian Patent Appln. No. 2,818,250.

* cited by examiner

ATMOSPHERIC BALL INJECTING APPARATUS, SYSTEM AND METHOD FOR WELLBORE OPERATIONS

CROSS REFERENCE TO RELATED APPLICATION

This application is a regular application of U.S. Provisional Patent Application Ser. No. 61/832,911 filed Jun. 9, 2013 and entitled, "ATMOSPHERIC BALL INJECTING APPARATUS, SYSTEM AND METHOD FOR WELLBORE OPERATIONS", the entirety of which is incorporated herein by reference.

FIELD OF THE INVENTION

The present invention relates to an apparatus, system and method to house, and control the release of, down-hole actuating devices for oil and gas wells. More particularly, the apparatus, system and method comprises an unpressurized (open to atmospheric pressure) ball selecting system to selectively present balls to a wellhead assembly.

BACKGROUND OF THE INVENTION

Down-hole actuating devices serve various purposes. Down-hole actuating devices such as balls, darts, etc. may be released into a wellhead to actuate various down-hole systems.

For example, in an oil well fracturing (also known as "fracing") or other stimulation procedures the down-hole actuating devices are a series of increasingly larger balls that cooperate with a series of packers inserted into the wellbore, each of the packers located at intervals suitable for isolating one zone of interest (or intervals within a zone) from an adjacent zone. Isolated zone are created by selectively engaging one or more of the packers by releasing the different sized balls at predetermined times. These balls typically range in diameter from a smallest ball, suitable to block the most downhole packer, to the largest diameter, suitable for blocking the most uphole packer.

At surface, the wellbore is normally fit with a wellhead including valves and a pipeline connection block, such as a frachead, which provides fluid connections for introducing stimulation fluids, including sand, gels and acid treatments, into the wellbore.

Conventionally, operators introduce balls to the wellbore through an auxiliary line, coupled through a valve, to the wellhead. This auxiliary line would be fit with a valved tee or T-configuration connecting the wellhead to a fluid pumping source and to a ball introduction valve. One such conventional apparatus is that as set forth in U.S. Pat. No. 4,132,243 to Kuus. There, same-sized balls are used for sealing perforations and these are fed, one by one, from a stack of identically sized balls held in a (generally) pressurized magazine.

However, the apparatus appears limited to using identically-sized balls in the magazine stack during a particular operation. To accommodate a set of balls of a different size, however, the apparatus of Kuus requires disassembly, substitution of various components (such as the magazine, ejector and ejector sleeve, which are properly sized for the new set of balls) and then reassembly. The apparatus of Kuus, therefore, cannot accommodate different sized balls during a particular operation, since it is designed to handle only a plurality of same-sized sealer balls at any one time.

To use a plurality of different sized balls, in the magazine, will result in jamming of the devices (such as in the ejector sleeve area).

Moreover, the ball retainer springs in Kuus do not appear to be very durable and would also need to be replaced when using a ball of a significantly different size. There is a further concern that the ball retainer springs could also break or come loss and then enter into the wellbore (which is undesirable). Additionally, there is no positive identification whether a ball was successfully indexed or ejected from the stack of balls for injection.

Furthermore, the device of Kuus is oriented so as to have the sealer balls transferred into the magazine by gravity and must therefore utilize a fluid flow line and valved tee through which well treating fluid and sealer balls are subsequently pumped into a wellbore. The device of Kuus, with its peculiar orientations of components, could therefore not be directly aligned with, or supported by, a wellhead.

More recent advance in ball injecting apparatus do feature a housing adapted to be supported by the wellhead. Typically the housing has an axial bore therethrough and is in fluid communication and aligned with the wellbore. This direct aligned connection to the wellhead avoids the conventional manner of introduce balls to the wellbore through an auxiliary fluid flow line (which is then subsequently connected to the wellhead) and the disadvantages associated therewith. Some of these disadvantages, associated with conventional T-connected ball injectors, include requiring personnel to work in close proximity to the treatment lines through which fluid and balls are pumped at high pressures and rates (which is hazardous), having valves malfunctioning and balls becoming stuck and not being pumped downhole and being limited to smaller diameter balls.

Examples of more recent ball injecting apparatus, which are supported by the wellhead, and are aligned with the wellbore, include those described in published U.S. Patent Application 2008/0223587, published on Sep. 18, 2008 and published U.S. Patent Application 2010/0288496, published on Nov. 18, 2010. Another example of a ball injecting apparatus supported by the wellhead and aligned with the wellbore is published U.S. Patent Application 2010/0294511, published on Nov. 25, 2010. Although these devices address many of the above issues identified with injection balls indirectly into the wellbore, i.e. via fluid flow lines, these still retain a significant number of disadvantages.

For example, it is know that the device taught in published U.S. Patent Application 2010/0294511, where each ball is temporarily supported by a rod or finger within the main bore. However, the pumping of displacement fluid through unit can damage or scar balls, especially if the displacement fluid is sand-laden fracturing fluid or if the balls are caused to rapidly spin on the support rod or finger. Such damaged balls typically fail to then properly actuate a downhole packer and fully isolate the intended zone. This then requires an operator to drop an identical ball down the bore which is extremely inefficient, time consuming, costly and can adversely compromise the well treatment.

The apparatus described in published U.S. Patent Application 2008/0223587, published on Sep. 18, 2008 teaches a ball magazine adapted for storing balls, in two or more transverse ball chambers, axially movable in a transverse port and which can be serially actuated for serially injecting the stored balls from the magazine into the wellbore. This overcomes a number of the disadvantages of the device taught in published U.S. Patent Application 2010/0294511. However, the invention contemplates loading the magazine externally from the ball injecting apparatus and, since the transverse chambers are transverse, cylindrical passageways or bores through the magazine's body with both horizontal and vertical openings, the plurality of balls can easily fall out of their respective chambers during preloading operations (i.e. through either entrance or exit openings). This could result in runaway balls on the surface next to the wellhead and potentially create a safety hazard. The design of this devices therefore makes the loading of the magazine difficult and time consuming, especially when loading a magazine with a large number of balls that must be monitored (i.e. to prevent the balls from exiting out through their respective entrance or exit openings) until placed within the axial bore of the apparatus.

Moreover, because the balls are serially positioned in a linear extending magazine, the ball injector of this patent application becomes cumbersome and unwieldy, especially when designed to work with 10, 12 or even 24 balls. For all practical purposes, the apparatus of this application is therefore limited to handling 5, or maybe 6, balls before becoming ungainly and unmanageable. As such, the applicant (of U.S. 2010/0294511) in a subsequent patent application, stated that this (earlier) apparatus retains a measure of mechanical complexity.

Published U.S. Patent Application 2010/0288496, published on Nov. 18, 2010, teaches a radial ball injection apparatus comprising a housing adapted to be supported by the wellhead. The housing has an axial bore therethrough and at least one radial ball array having two or more radial bores extending radially away from the axial bore and in fluid communication therewith, the axial bore being in fluid communication and aligned with the wellbore. Each radial bore has a ball cartridge for storing a ball and an actuator for moving the ball cartridge along the radial bore. The actuator reciprocates the ball cartridge for operably aligning with the axial bore for releasing the stored ball and operably misaligning from the axial bore for clearing the axial bore. This patent application also teaches that several of the radial ball arrays can be arranged vertically within one housing, or one or more of the radial ball arrays can be housed in a single housing and vertically by stacked one on top of another for increasing the number of available balls. For example, in one embodiment, it describes using an injector having two vertically spaced arrays of four radial bores so as to drop eight (8) ball.

However, published U.S. Patent Application 2010/0288496 suffers from a number of disadvantages including icing issues during winter operations which can result in the balls being frozen within their respective ball cartridges which have a cup-like body comprised of an open side, a lateral restraining structure and a supporting side for seating the ball during loading. However, during winter operations, the balls can become frozen within this cup-like body, thereby preventing proper release of the balls downhole. For that reason, U.S. Patent Application 2010/0288496 teaches that one should use methanol in the displacement fluid to reduce such icing issues. However, using methanol adds to the expense and complexity of the ball injection process.

Moreover, and although U.S. Patent Application 2010/0288496 teaches an indicator for indicating a relative position of the ball cartridge between the aligned and misaligned positions, this indicator does not indicate whether a ball was actually released from the cup-like structure, when placed in the aligned position, or whether it remains stuck and frozen within the ball cartridge, only to be retracted back into the radial bore when returned to the misaligned position. Therefore an operator of this apparatus cannot accurately determine whether a ball was successfully released from the injector as taught in this patent application.

A further disadvantage of the apparatus taught by U.S. Patent Application 2010/0288496 is that each of the balls are loaded through the axial bore of the injector by rotating the ball cartridge into a receiving position and then aligning each ball cartridge with the axial bore so as to be able receive a ball from above as it is dropped through the axial bore. This results in a time consuming an awkward loading procedure wherein balls are loaded serially, one after another, with each ball cartridge then being stroked between misaligned, aligned and then misaligned position. In an alternate loading procedure, this application suggest to preload the apparatus by removing the ball cartridges from each housing, seating the balls into each ball cartridge, and then reinstalling the loaded ball cartridges on each radial housing. This alternate loading procedure is also time consuming and awkward.

Additionally, in the primary suggested loading procedure, the balls will need to be carefully aligned along the axial bore and above its particular ball cartridge before being dropped, so as to avoid missing the ball cartridge and then having the ball continue on downward the axial bore. If a dropped ball does miss the intended ball cartridge and continues downward the axial bore then, in a best case scenario such as during pre-loading, the ball exits at the bottom end of the injector to be simply retrieved and loading can then be attempted again. However, if a dropped ball misses the intended ball cartridge when the injector is mounted to the wellhead structure or above a gate valve, then the injector will have to be disconnected from the wellhead or gate valve so as to then retrieve the ball. In a worst case scenario, a ball that is dropped in the axial bore and which misses the ball cartridge could prematurely be launched down the wellbore and premature activate one or more downhole tools (such as packers), resulting a ruined fracturing operation. As such the application even teaches use of a calibrated tubular or sleeve to assist with the loading of the balls through the axial bore. This additional piece of equipment adds further complication to the apparatus and loading procedure.

Another disadvantage of these prior art devices is that they all require that the plurality of balls are all subject to the pressurized environment of the wellbore, while they are waiting to be released into the wellbore. One disadvantage of having all of the ball subject to wellbore pressure is that additional sealing components and engineering specifications (e.g. to meet typical 10,000 psi pressure rating) are required for these devices, making such ball injecting apparatus more complex and more expensive than would otherwise be the case. Furthermore, such prior art ball injecting apparatus has a potential for many different pressure leak points; thereby creating a potential safety hazard. Another disadvantage of having all the preloaded balls subject to wellbore pressure is that the entire ball injecting apparatus will need to be depressurized in order to reload and/or change ball sizes.

As such, there remains a need for a safe, simple and efficient apparatus and mechanism for loading balls therein and for subsequent introducing such balls into a wellbore.

BRIEF DESCRIPTION OF THE DRAWINGS

Embodiments of the invention will now be described, by way of example only, with reference to the accompanying drawings, wherein.

DETAILED DESCRIPTION OF THE PREFERRED EMBODIMENTS

Figure 1:
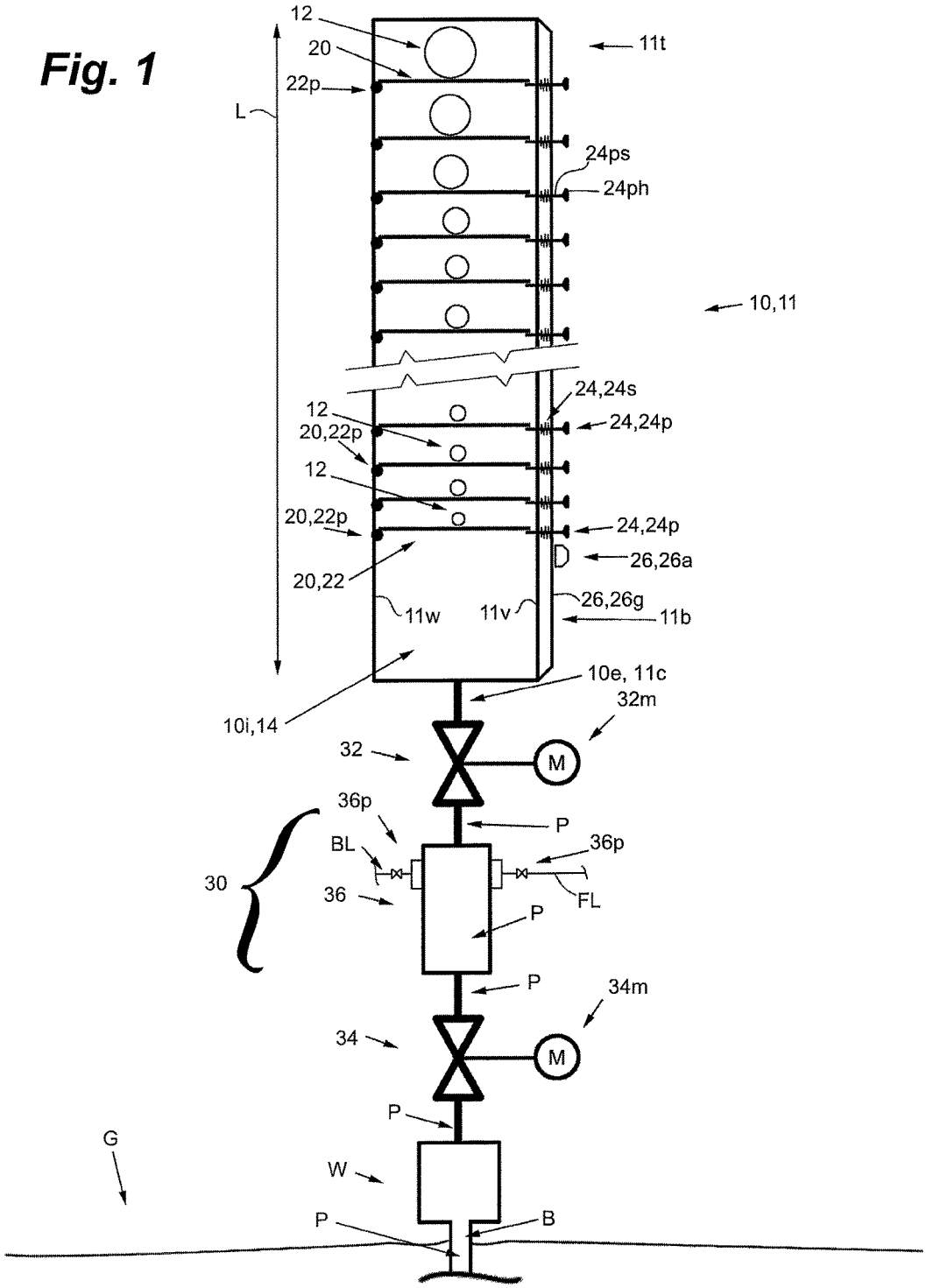
FIG. 1 is a schematic diagram of an embodiment of the invention.
Figure 2A:
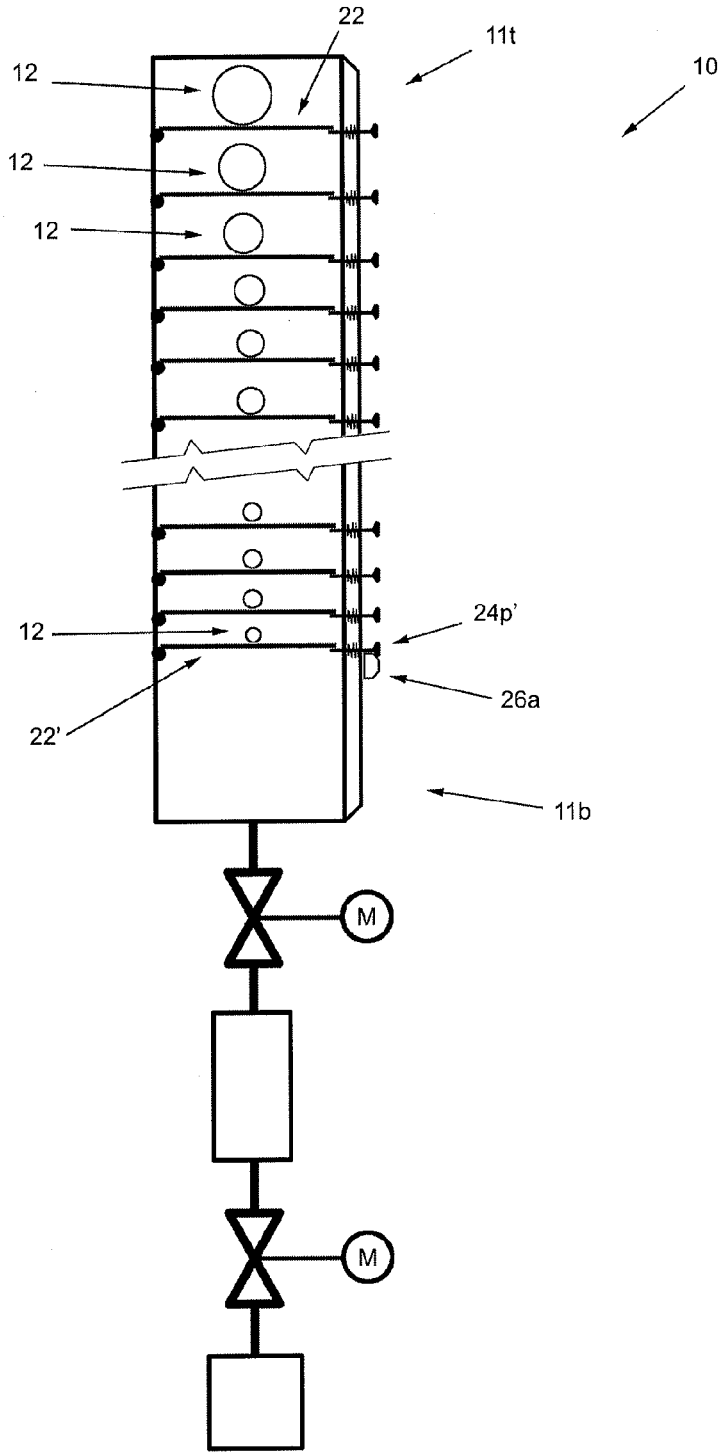
FIGS. 2*a*-2*g* are schematic diagrams of the embodiment of FIG. 1, illustrating how a series of balls may be selectively launched into a wellhead assembly.
Figure 2B:
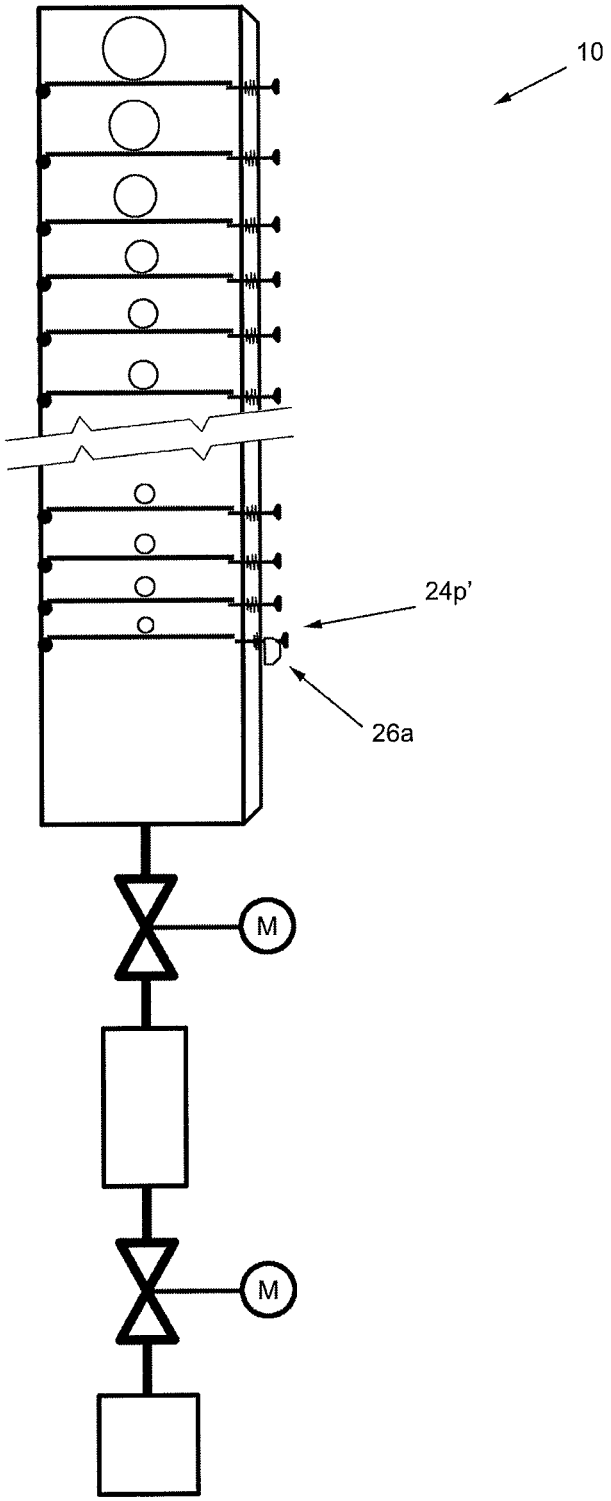
Figure 2C:
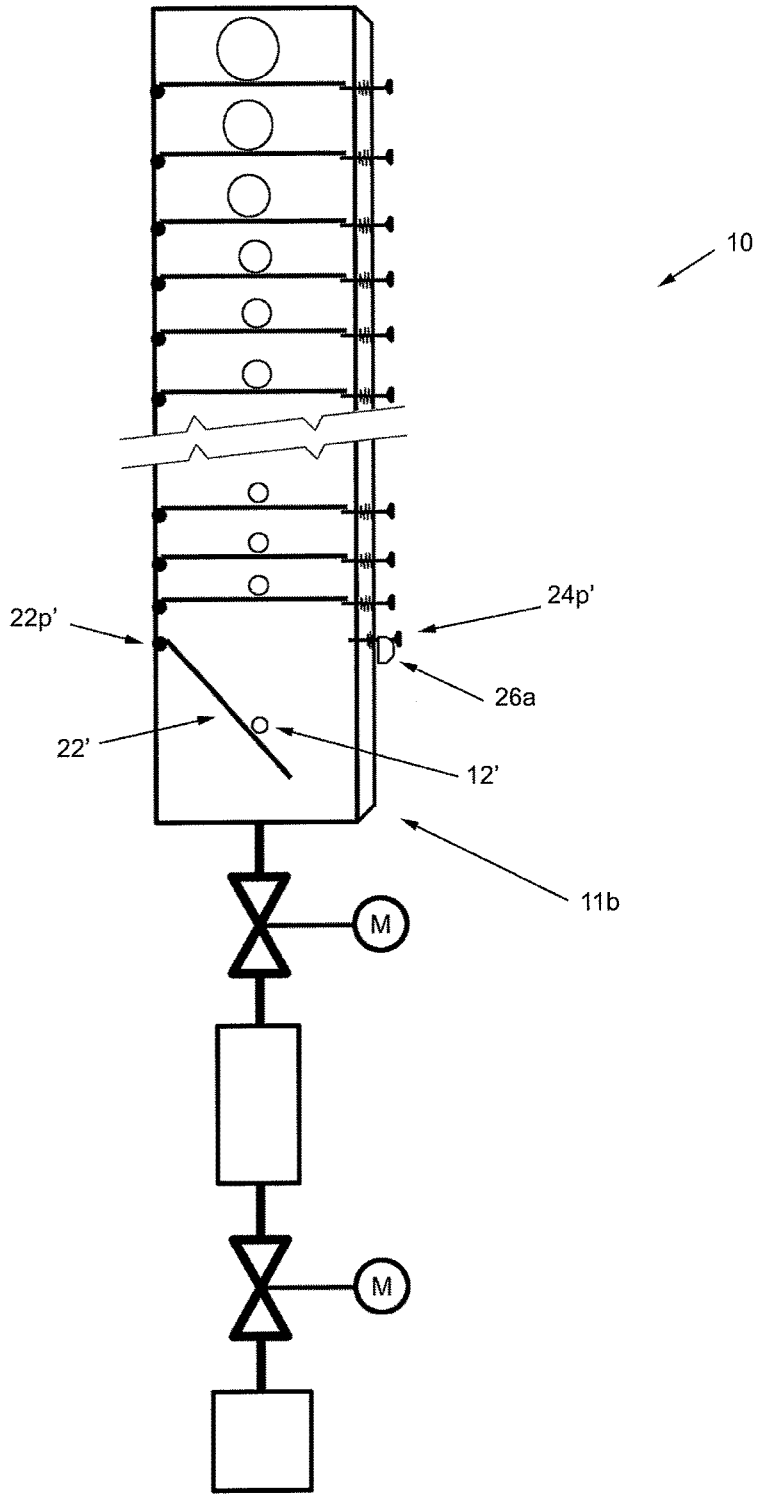
Figure 2D:
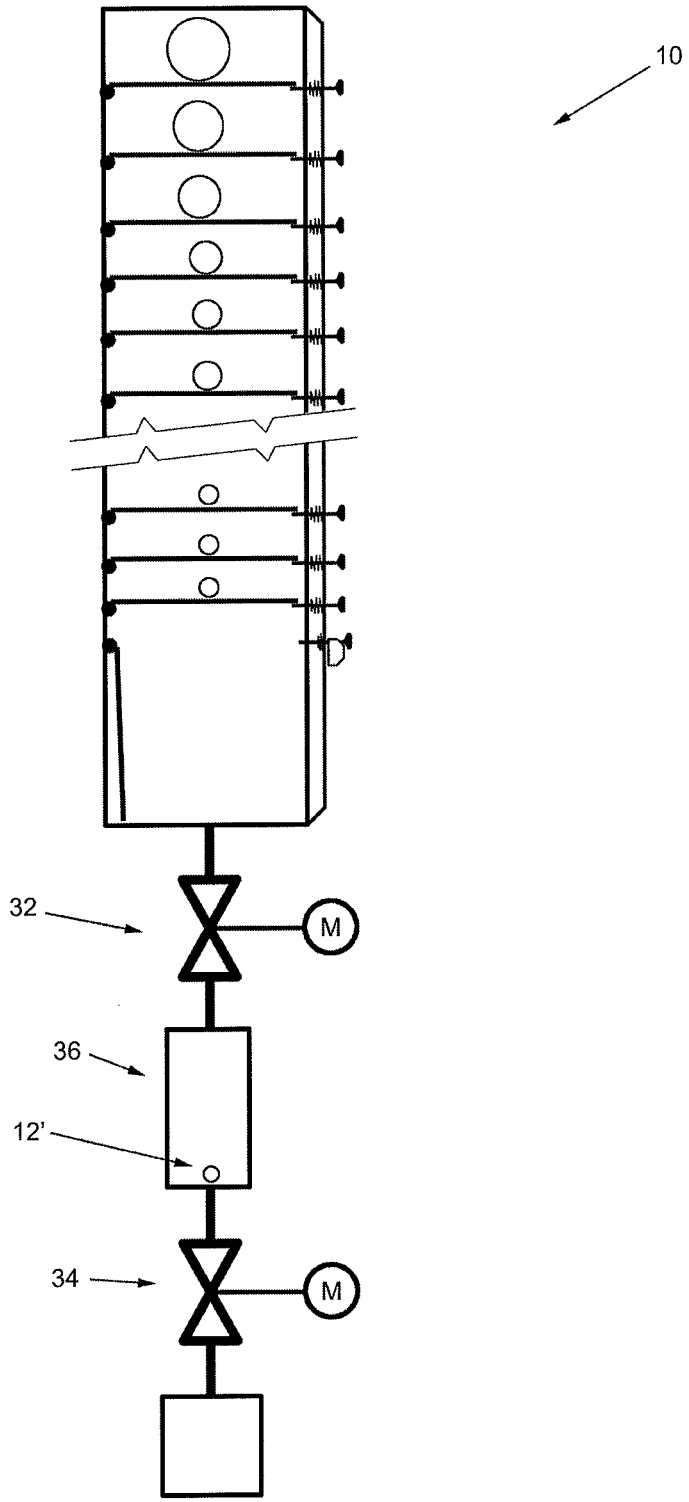
Figure 2E:
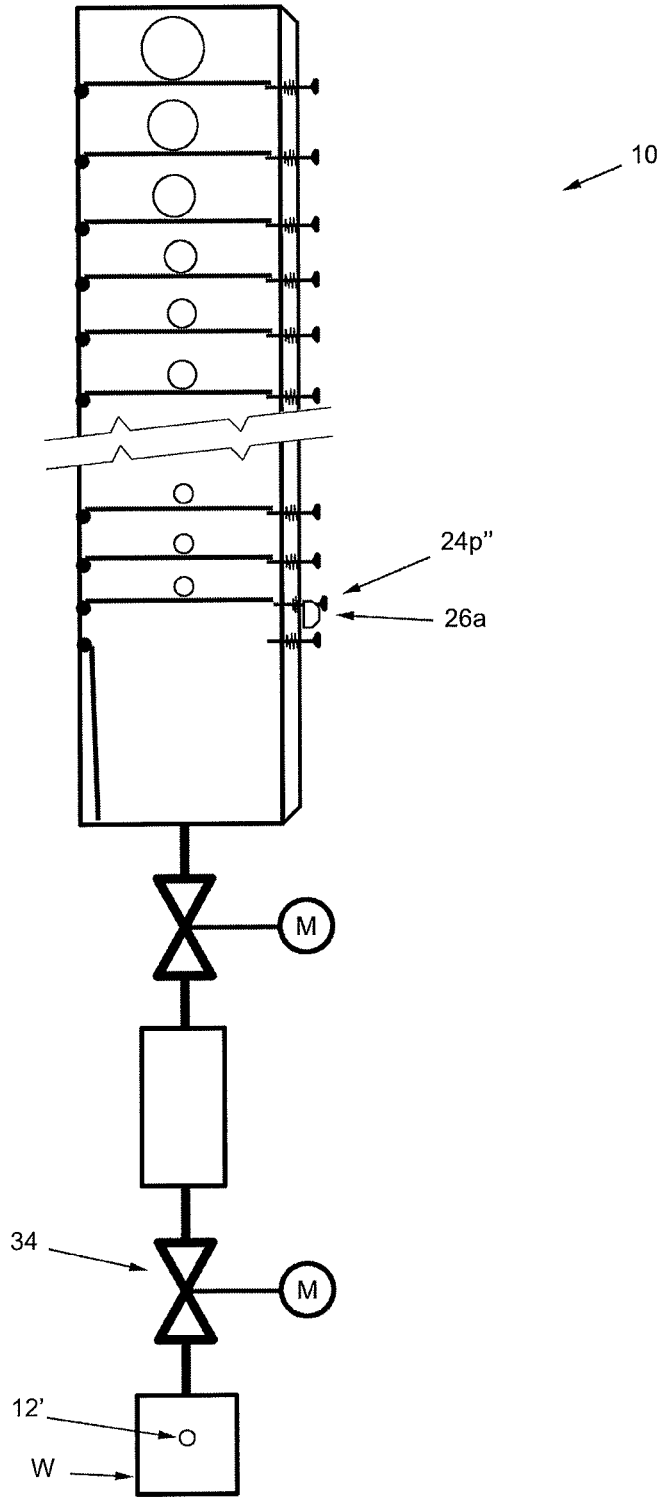
Figure 2F:
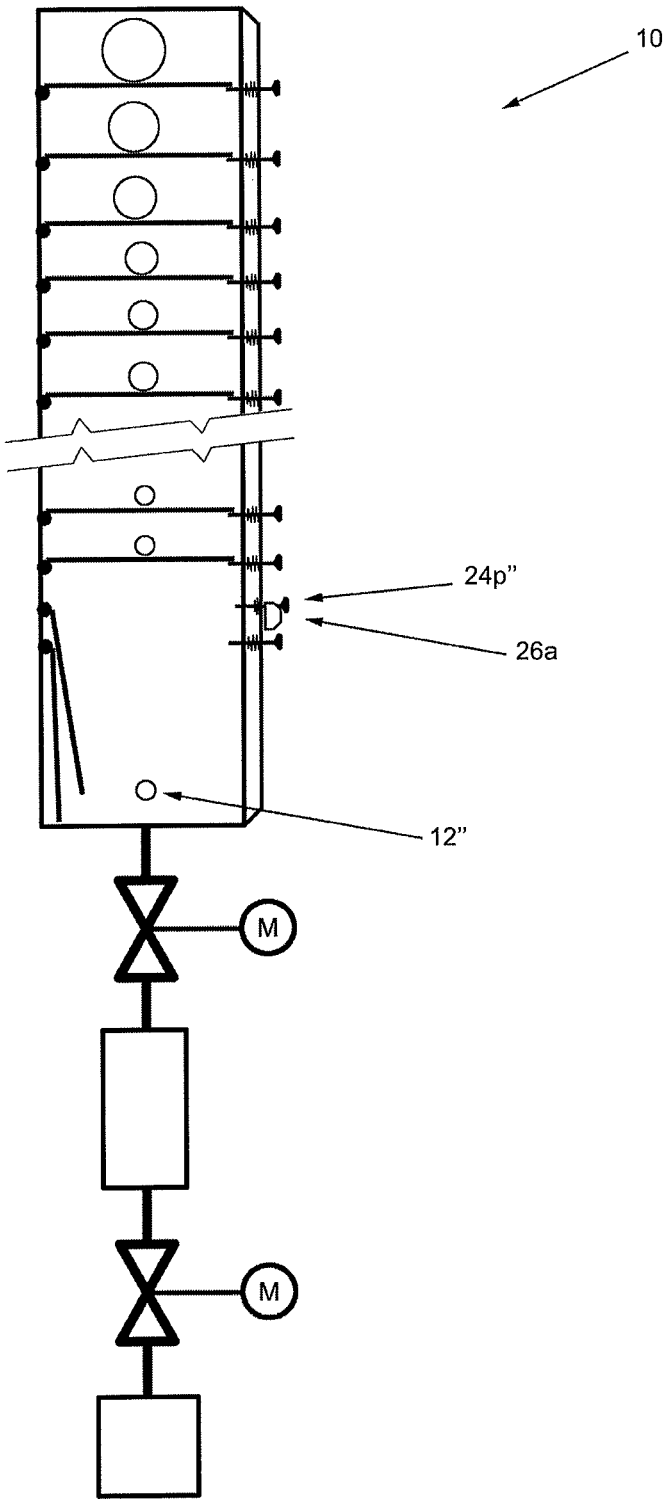
Figure 2G:
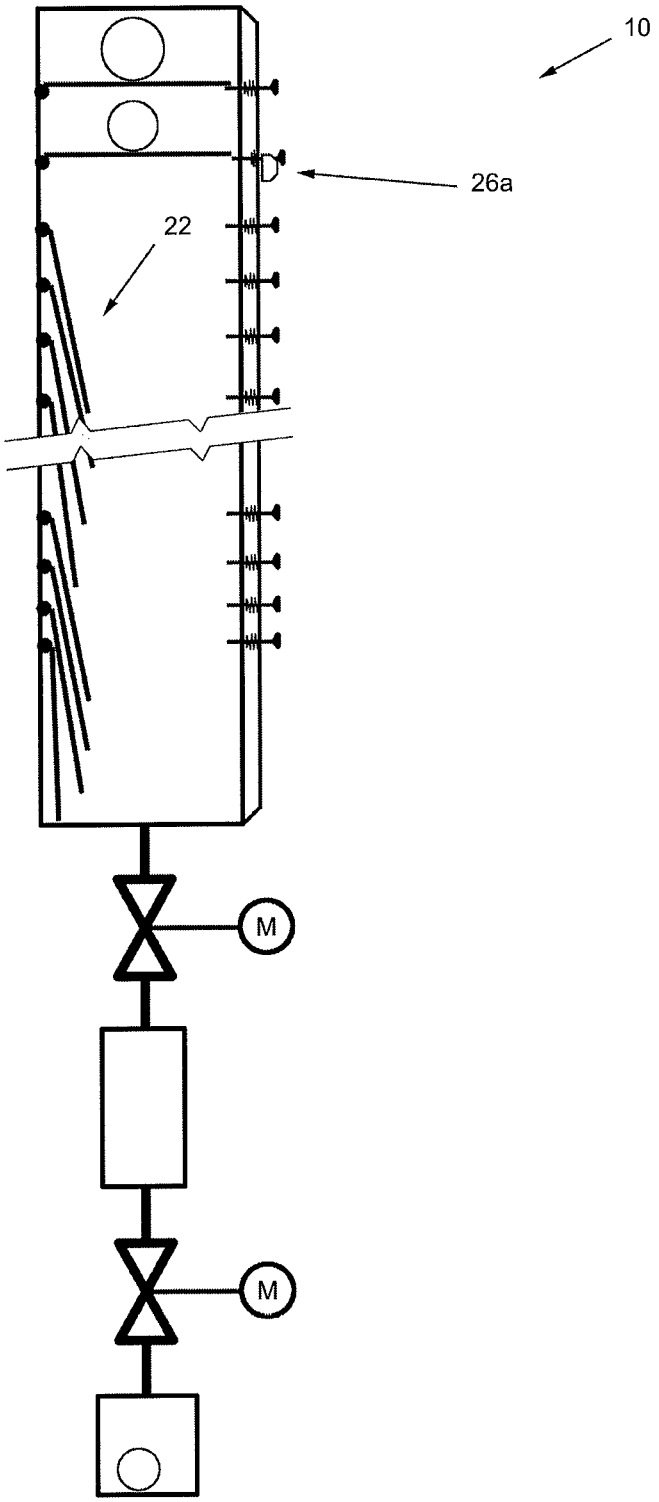

The following description is of a preferred embodiment by way of example only and without limitation to the combination of features necessary for carrying the invention into effect. Reference is to be had to the Figures in which identical reference numbers identify similar components. The drawing figures are not necessarily to scale and certain features are shown in schematic or diagrammatic form in the interest of clarity and conciseness.

With reference to the Figures, and generally in accordance with a preferred embodiment of the invention as shown in FIGS. 1-3*f*, a ball injecting apparatus or injector 10 receives and releases balls 12, including drop balls, frac balls, packer balls, and the like, into a wellhead assembly 30 for subsequent release down a wellbore B to, for example, isolate zones of interest during wellbore operations such as fracturing. The injector 10 is preferably supported on a wellhead or wellhead structure W connected to the wellbore B that is positioned above the ground G (see FIG. 1).

A wellhead assembly 30 is provided between the injector 10 and the wellhead W. More preferably, wellhead assembly 30 comprises an upper valve 32 and a lower valve 34 and a staging assembly or accumulator 36 positioned therebetween. The wellhead assembly 30 and its various components 32,34,36 are preferably standard API pressure control equipment suitable to handle typical wellbore pressures, with conventional ports to allow for pressure bleed offs and injection of fluid and methanol, including, preferably, the access ports 36*p* mentioned below. The wellhead assembly 30 and its various components 32,34,36 have a bore or passage P sufficiently large to permit the passage of the balls 12 therethrough. The upper valve 32 and lower valve 34 are preferably gate valves, but they may also be another type of suitable valve. Preferably, the upper valve 32 and lower valve 34 are each actuated by a motor 32*m*, 34*m* respectively. More preferably, the motors 32*m*, 34*m* are remotely actuable, such as via a control panel (not shown). The wellhead assembly 30 may also include a high pressure wellhead or a frac head (not shown) having a bore sufficiently large to permit the passage of the balls 12 therethrough.

Preferably, staging assembly comprises one or more access ports 36*p* (see FIG. 1) for sealably connecting to fluid lines (not shown) to, for example, depressurize/bleeding-off internal pressure and/or for receiving pressurized fluid (so as to pressurize/re-pressurize the internal volume and passage P of the assembly 36 to wellbore pressure; and/or to for supplying a fracturing or stimulating fluid to the wellbore B). Preferably, access ports 36*p* are valved. Alternatively, the wellhead assembly 30 comprises only an upper valve 32 and a lower valve 34 (i.e. without a staging assembly), with any access ports then being incorporated into the top part of the lower valve 34 (or bottom part of the upper valve 32) so as to be able to pressurize/depressurize the internal volume and passage P between the upper and lower valves 32,34.

In the context of fracturing or treating sequential zones within a formation accessed by the wellbore B, flow passage P of the wellhead assembly 30 is fluidly connected to the wellbore B through the wellhead W and said assembly 30 is designed to handle wellbore pressures. The wellhead assembly 30 may be connected to pump trucks (not shown) through a fluid line FL for supplying a fracturing or stimulation fluid to the wellbore B in a conventional manner, such as through ports 36*p* in the staging assembly 36 at a point below the injecting apparatus 10 and below the upper valve 32. A bleed-off line BL is preferably provided to allow depressurization of the internal volume and passage P of the staging assembly 36.

Figure 3A:
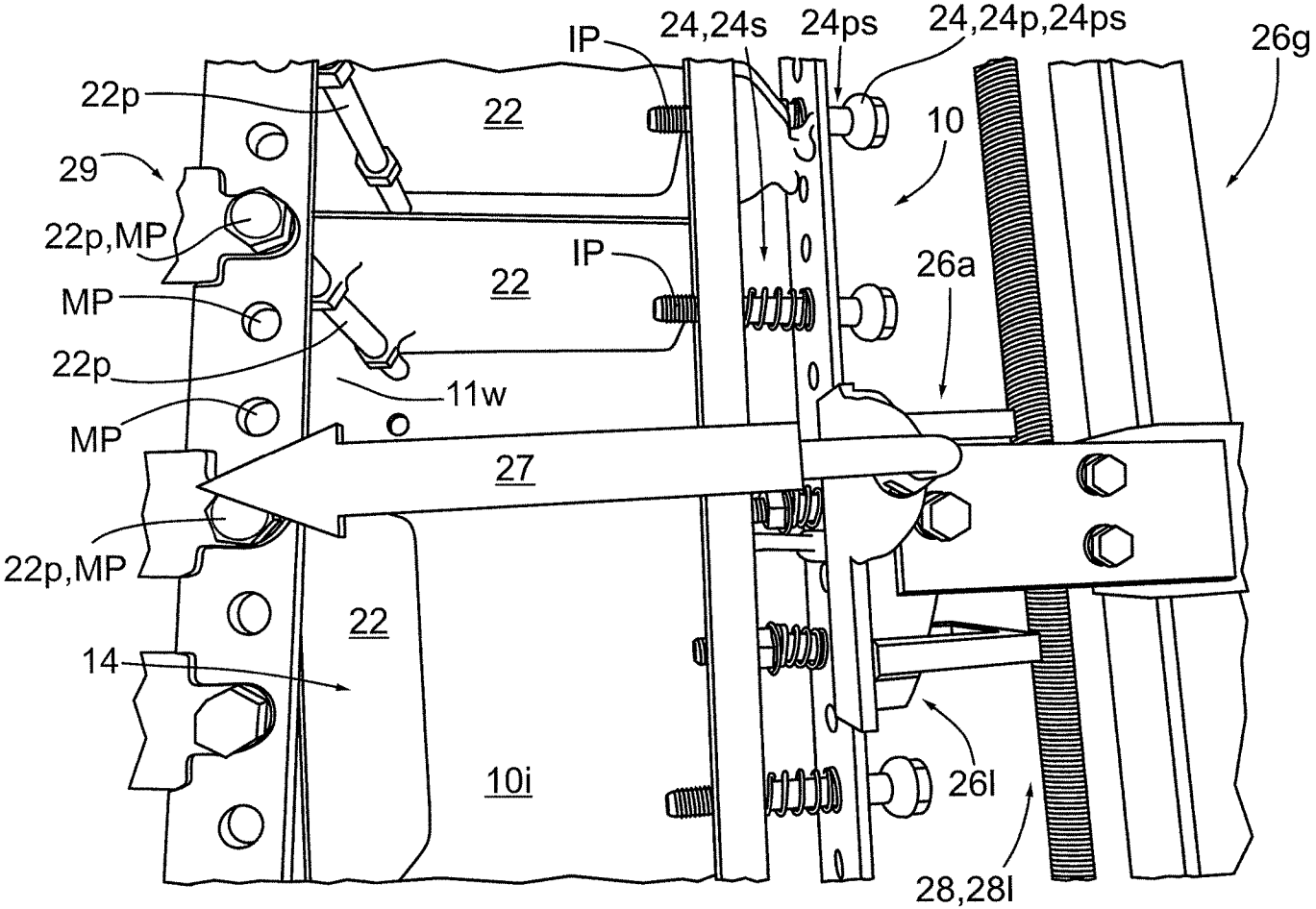
FIG. 3*a* is a perspective view of one embodiment of a pin actuator having a visual indicator.
Figure 3B:
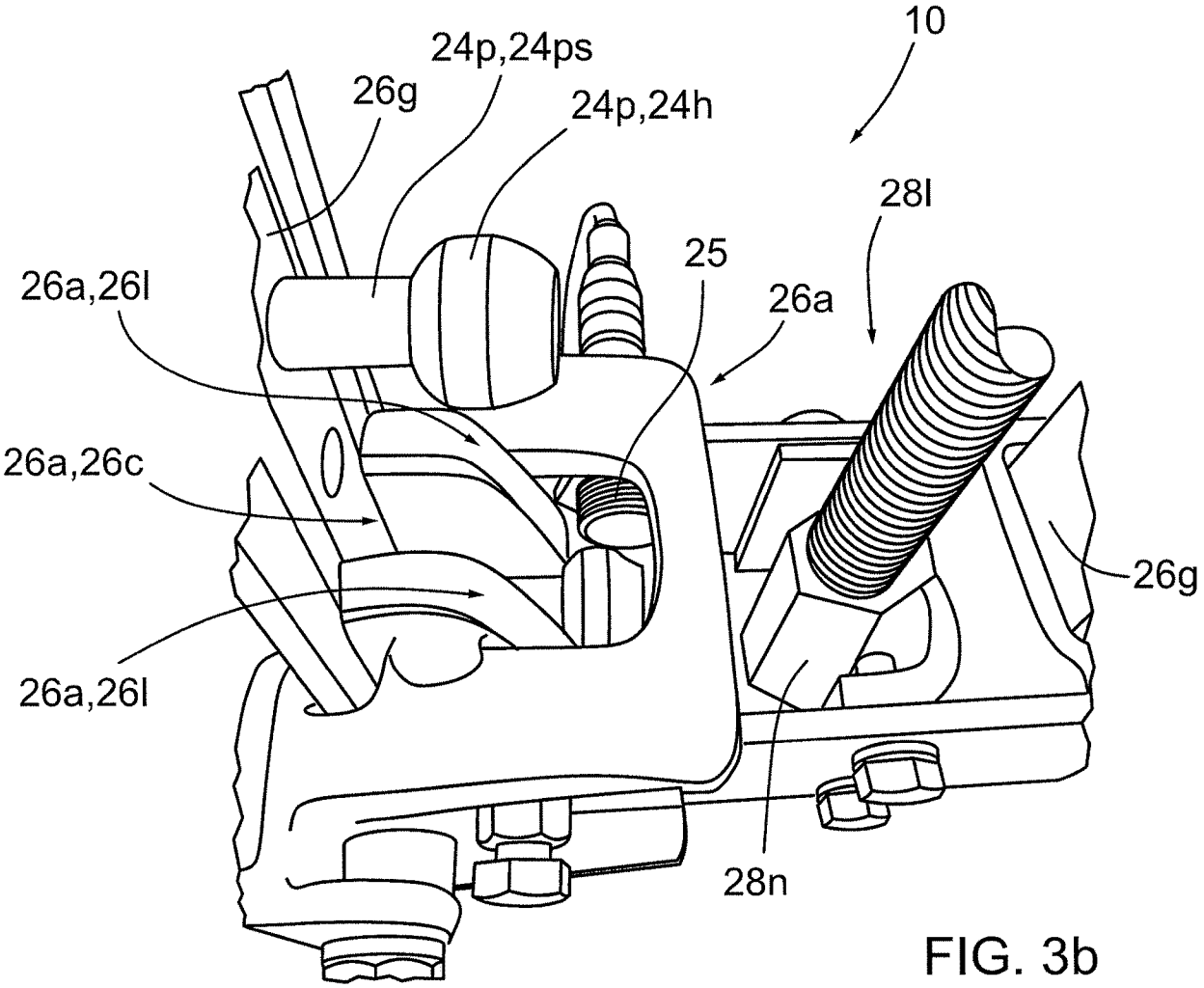
FIG. 3*b* is a close-up perspective view of the pin actuator of the embodiment of FIG. 3*a*, illustrating how the pin actuator pulls back a pin.
Figure 3C:
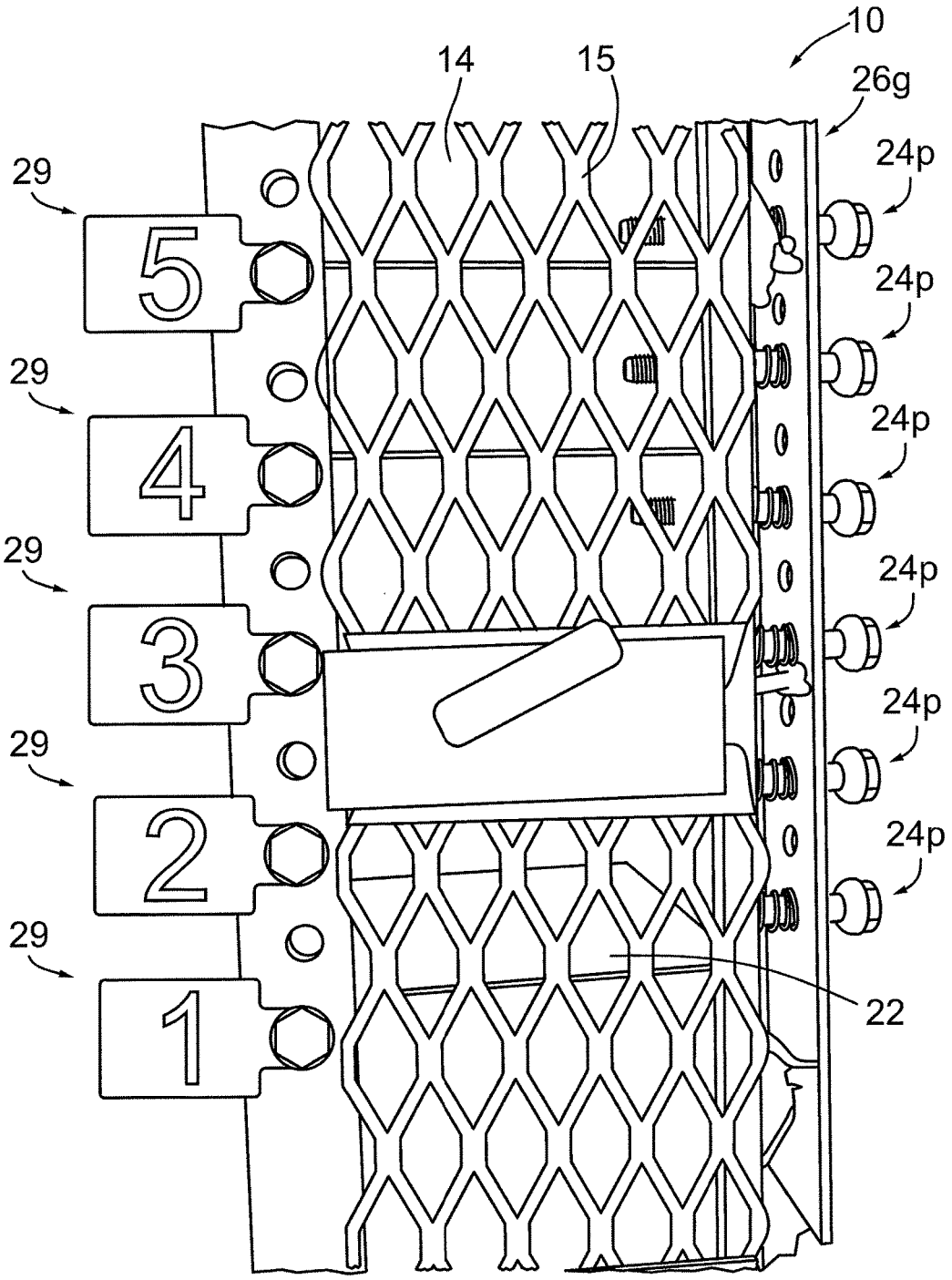
FIG. 3*c* is a close-up perspective view of an embodiment of a ball selection apparatus, showing a plurality of retaining members, pins and removeable, see-through cover or grate to provide visual access to the interior of said ball selection apparatus.
Figure 3D:
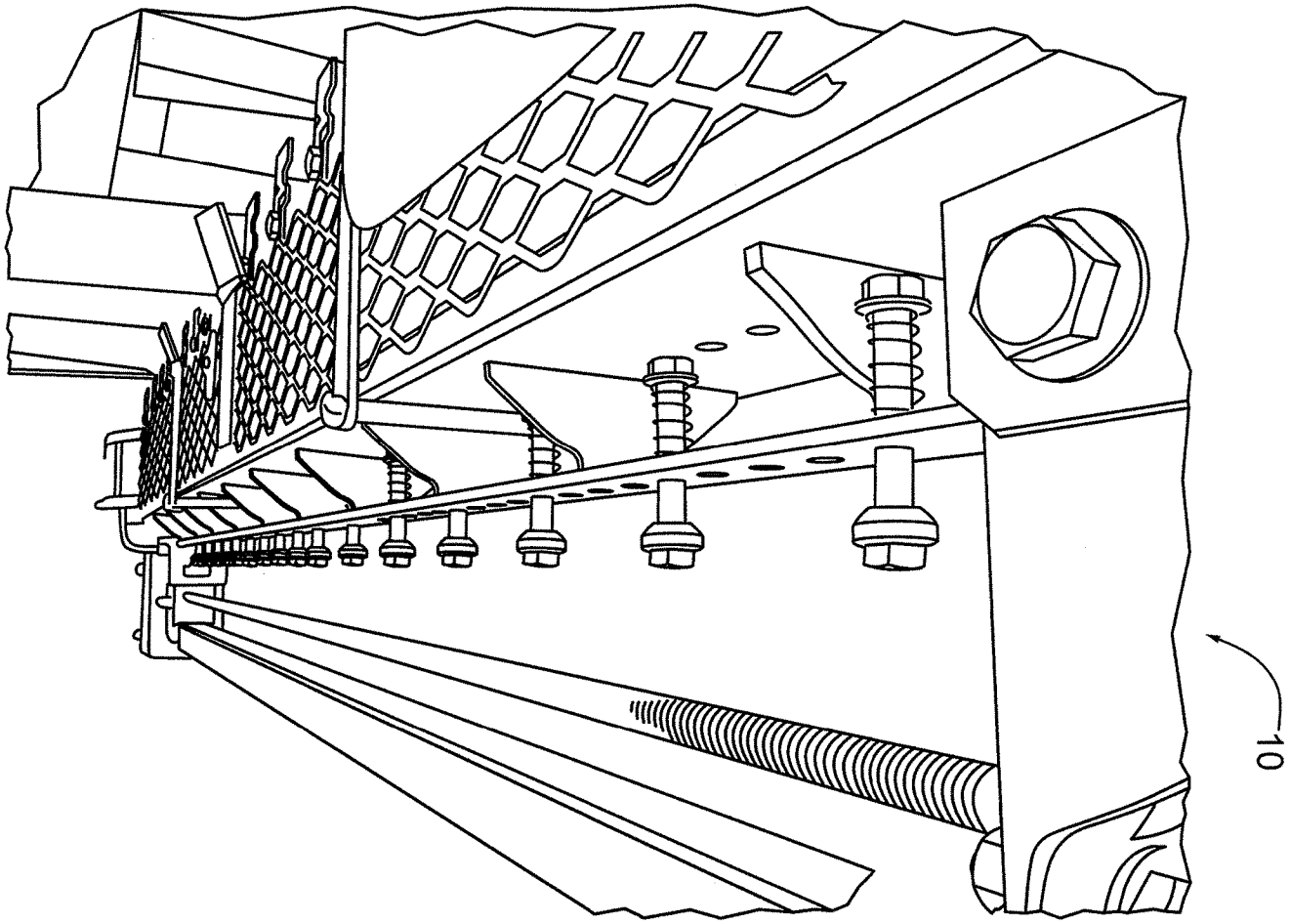
FIG. 3*d* is a perspective view of the ball selection apparatus of the embodiment of FIG. 3*c*, showing a plurality of pins and the pin actuator of the embodiment of FIG. 3*a;*
Figure 3E:
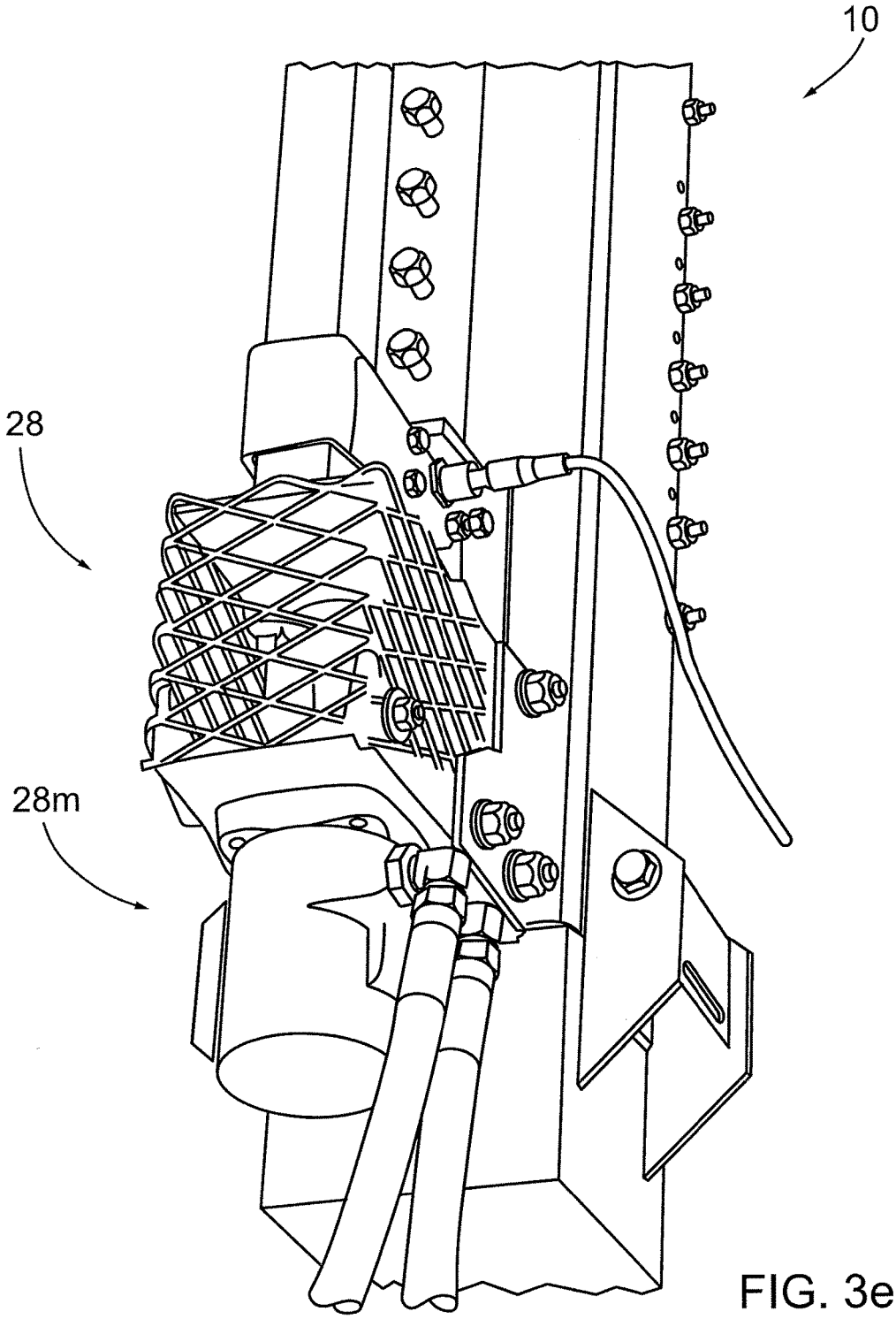
FIG. 3*e* is a perspective view of the ball selection apparatus of the embodiment of FIG. 3*c*, showing one embodiment of a motor to drive the pin actuator.

The injector 10, however, is open to atmospheric pressure and preferably further comprises one or more windows 14 to allow for fluid communication with the atmosphere, to provide for placement and removal balls 12 into and out of the injector's interior 10*i* and to allow an operator of the injector 10 to look inside and inspect the interior 10*i* and any balls 12 that may be placed therein. Preferably, and as can be seen in FIGS. 3*a* and 3*c*, window 14 is simply an opening or cut-out through a portion of the body 11, said cut-out opening preferably running substantially the length of the body 11, along substantially one side thereof, between top end 11*t* and bottom end 11*b*, thereby ensuring that interior 111 of the injector 10 remains open to atmospheric pressure, including during ball injection operations. Advantageously, one or more windows 14 allow for an operator to accurately determine whether a particular ball 12 was successfully released from the injector (something that is not possible with the prior art devices which do not have such window, due to pressure requirements and/or API standards) and provides for continuous communication of gasses between the injector's interior 10*i* and outside atmosphere. Preferably, a removable (or pivotable) gas-permeable cover or grate 15 is provided to ensure that any balls 12 placed within the injector's interior 10*i* remain inside during operations, while still ensuring that the interior 111 of the injector 10 remains open to atmospheric pressure. Advantageously, the cover 15 can be removed (or pivotably opened) to provide access to the interior 10*i*, via window 14, when desired. Preferably the cover 15 is see-through.

The ball injector 10 preferably comprises an elongate body 11 having a top end 11*t*, a bottom end 11*b* and a longitudinal axis L that runs therebetween. Preferably, during operations, the ball injector 10 is positioned in a substantially upright and vertical manner with bottom end 11*b* mounted to the top valve 32 of the wellhead assembly 30.

Elongate body 11 provides that balls 12, placed in the interior 10*i*, may travel along the interior 10*i* between the top end 11*t* and bottom end 11*b* (preferably, as gravity acts upon such balls 12). Accordingly, interior 10*i* is sufficiently large to permit the passage of the balls 12 therethrough. Bottom end 11*b* further comprises an opening or exit 10*e* of suitable dimensions so as to allow balls 12 to exit the interior 10*i*, thereby allowing the injector 10 to release and present balls 12 to the wellhead assembly 30, as may be desired during operations (e.g. sequentially presenting a series of balls 12 of increasing diameter).

Figure 3F:
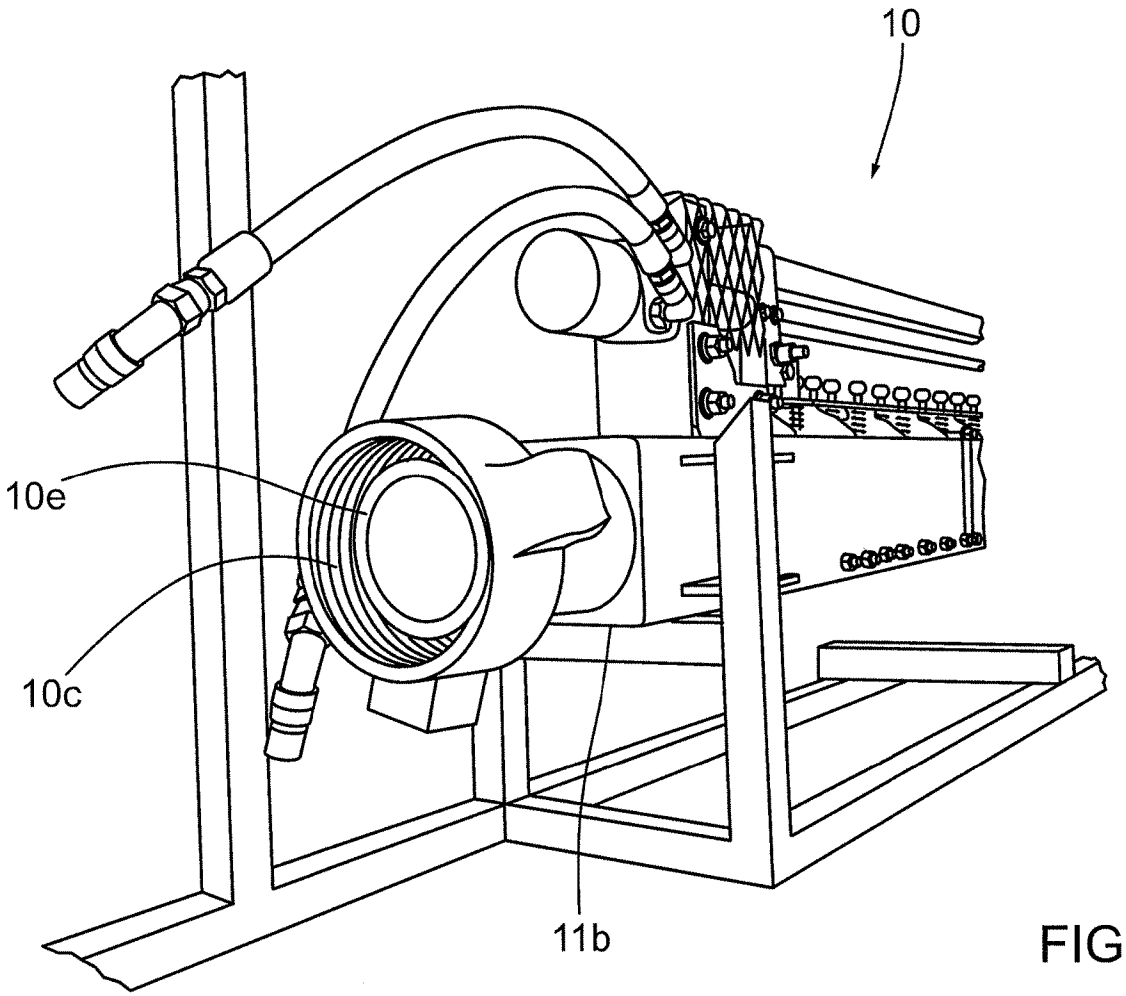
FIG. 3*f* is a perspective view of the ball selection apparatus of the embodiment of FIG. 3*c*, showing a threaded connector for connecting the apparatus to a wellhead assembly.
Figure 4:
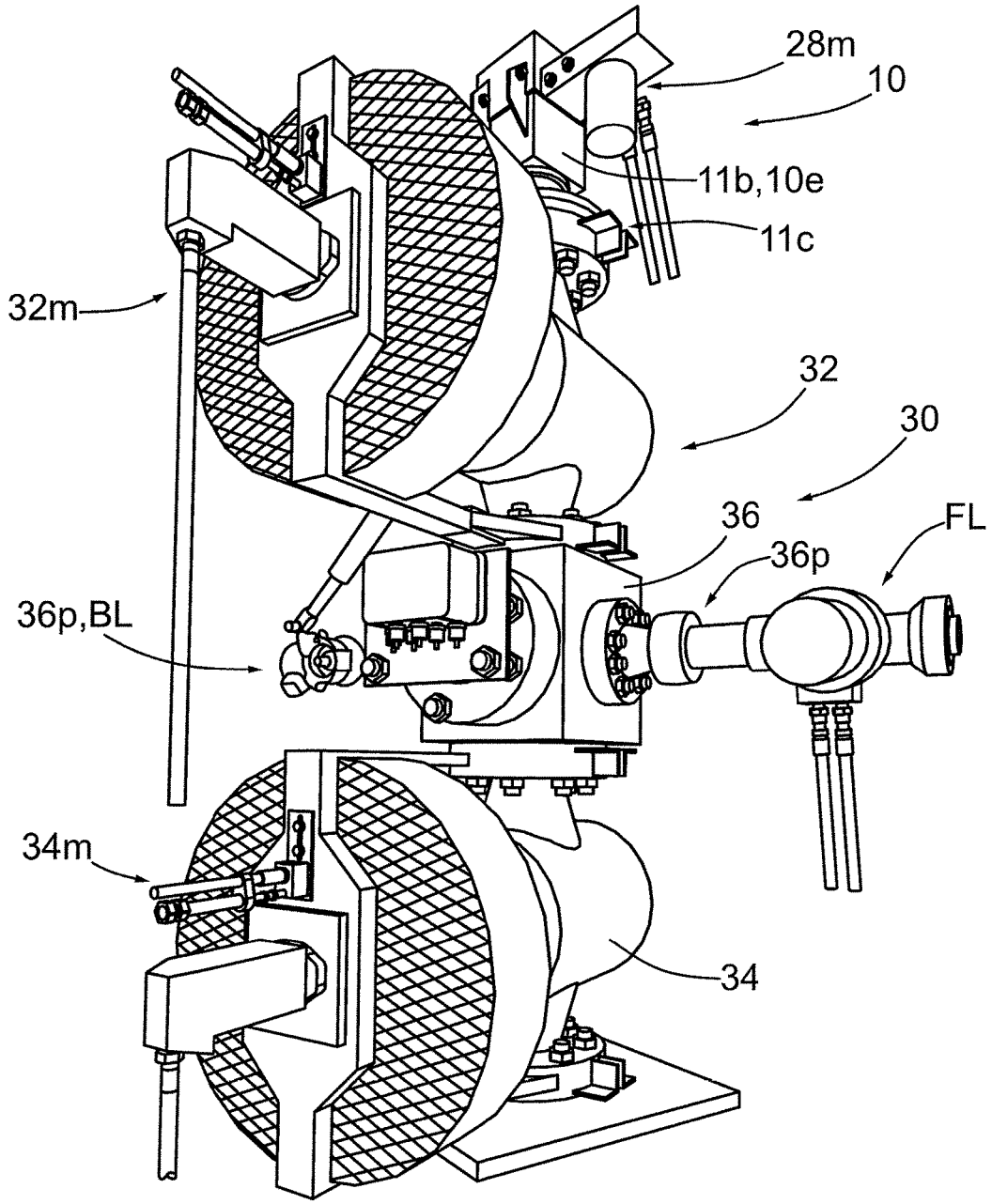
FIG. 4 is perspective view of another ball selection apparatus, showing a flanged connector connecting the apparatus to a wellhead assembly.

Bottom end 11*b* may be formed with a connection 11*c* around exit 10*e* that can be secured onto the top valve 32 of the wellhead assembly 30 and facilitate the release of balls 12 from the injector 10 into the flow passage P of the wellhead assembly 30. The connection 11*c* may be a threadable connection (e.g. as shown in FIG. 3*f*), a flanged connection secured by bolts (e.g. as shown in FIG. 4) or some other suitable connection.

The injector 10 is provided with a ball retaining and release mechanism 20, to retain and selectively release one or more balls 12 from the injector's interior 10*i* out through the exit 10*e* and thereby present said one or more balls 12 to the wellhead assembly 30 (or other wellhead apparatus) as may be desired during operations. In a preferred embodiment, the ball retaining and release mechanism 20 further comprises a series of retaining members 22 pivotally mounted to an inside side wall 11*w* of the elongate body 11, i.e. within the interior 10*i* of the injector 10, preferably with all members 22 pivotally mounted to the same interior side wall 11*w*. The retaining members 22 are capable of pivoting between closed and opened positions, e.g. at a pivot point 22*p* that is substantially at said side wall 11*w*. The retaining members 22 are of adequate dimensions to block passage of the balls 12 and control their movement when in the closed position (e.g. see FIG. 1) and to allow balls to travel along the interior 10*i* towards the exit 10*e* when in the open position (e.g. see FIGS. 2*c* and 2*f*). The closed position can also be referred to as a blocking position, because the retaining member 22 blocks movement of the balls 12 along the longitudinal axis. The open position can also be referred to as a release position, because ball 12 that may be supported by a member 22 is released to the exit 10*e*.

Retaining member 22 is preferably a flat planar member that, when in the closed position is substantially perpendicular to the longidutinal axis L, and when in the open position is substantially parallel to the longitudinal axis L (e.g. as shown in FIG. 3*a*). When in the closed position, the preferred embodiment of the retaining member 22 can support a ball 12 when said ball 12 is placed on said member 22 (e.g. all of the balls 12 shown in FIG. 1 are each supported by a retaining member 22 held in the closed position). Preferably, a plurality of retaining members 22 are provided along the interior 10*i*, each substantially above the next along the longitudinal axis L. The retaining member 22 may also be in another form, such as in the form of a grate or a rigid mesh or other structure, that can be pivoted while still also capable of holding/retaining a ball.

The retaining members 22 preferably are free to pivot (at point 22*p*) and will normally tend towards the open position due to gravity acting on them. In the preferred embodiment of the ball retaining and release mechanism 20, the mechanism 20 further comprises a series of retaining member locks 24 that function to keep the retaining members 22 in the closed or blocking position, i.e. one lock 24 associated with each one of the retaining member 22. In this preferred embodiment, the retaining member locks 24 further comprise a pin 24*p* that is biased by a spring 24*s* to an interference position IP with the retaining member 22 (e.g. through side wall 11*v*), so as prevent said member 22 from pivoting from the closed position into the open or release position (see FIG. 3*a*). Preferably, retaining member locks 24 (and pins 24*p* and springs 24*s*) are positioned on a side wall 11*v* of the injector 10 that is opposite to the side wall 11*w* having the pivot point 22*p* (as is more clearly shown in the figures). During operations, pins 24*p* may be selectively pulled back (against the bias of the spring 24*s*), so as to allow retaining members 22 to pivot from the closed position to the open position, thereby releasing one or more balls 12 as may be desired during operations. This may be done manually or a suitable actuator system may be provided.

FIGS. 2*a*-2*g* illustrate an injector 10 having a plurality of retaining members 22, each pivotally mounted to the interior side wall 11*w* and held in the closed position by a retaining member lock 24. The retaining members are serially positioned one above the other within the interior 10*i*. A series of balls with increasing diameters is placed on the plurality of retaining members 22, i.e. one ball 12 being supported by one retaining member 22 (placed in the closed position), with the ball sizes increasing in diameter when going from the bottom end 11*b* to the top end 11*t*; i.e. the bottom most retaining member 22 within the injector 10 supports the smallest diameter ball 12, while the top most retaining member 22 supports the largest diameter ball.

Sufficient space and clearance is provided between each of the pivotally mounted retaining members 22 to allow for placement and support of the respective sized ball therebetween (note, for example, that more clearance is provided between the upper most retaining members 22, so as to support the larger diameter balls 12, than compared to the lower most retaining members 22, which only need to support the smaller diameter balls). Preferably, a plurality of preset pivot mounting points MP (where retaining members 22 can be selectively pivotally mounted) are provided so that a plurality of retaining members 22 can be mounted within the injector 10 at various positions, thereby allowing for easy adjustment in the clearance that may be between adjacent retaining members 22 (see FIG. 3*a*). Advantageously, the plurality of mounting points MP allow the injector to easily handle a large variety of ball diameter sizes—i.e. by simply and quickly adjusting the particular pivot points 22*p* of adjacent retaining members 22.

Preferably, a lock actuator system 26 is provided to selectively pull back the pins 24*p* (against the bias of the spring 24*s*), so as to allow retaining members 22 to pivot from the closed position to the open position, thereby releasing one or more balls 12 as may be desired during operations. In the preferred embodiment, the lock actuator system 26 further comprises a pin actuator 26*a* slidably mounted on one or more guides 26*g* for movement substantially along the side of the injector 10 having the pins 24*p* (i.e. adjacent wall 11*v*) and substantially parallel to the longitudinal axis L. Pins 24*p* preferably comprises a shaft region 24*ps* and a head region 24*ph* and pin actuator 26*a* preferably comprises a channel region 26*c* suitable to accept the pins shaft 24*ps* therein and a lifting member 261 suitable to engage the pin head 24*ph* and, as pin actuator 26*a* moves along guide 26*g* past a particular pin, engage the pin head 24*ph* sufficiently so as to pull back said particular pin 24*p* (against the bias of the spring 24*s*), so as to allow retaining members 22 to pivot from the closed position to the open position—see, for example FIG. 3*b* where lifting member 261 comprises two wedge shaped members, forming channel region 26*c* therebetween, and the angled surfaces of the wedge shaped members pulling the pin 24*p* back (by engaging the pin head 24*ph*) as the pin actuator 26*a* is moved past the pin 24*p*.

Preferably, a proximity sensor 25 is provided on pin actuator 26*a* to sense when a pin head 24*ph* is sufficiently moved along lifting member 261 to release the relevant retaining member 22 to the open position; advantageous, sensor output from such proximity sensor can be used by a control system to monitor and control operation of the injector 10 (e.g. to indicate that a pin 24*p* was pulled and, hence, that a particular retaining member 22 was released to the open position and any ball 12 retained by such member 22 to then be released from the injector into the wellhead assembly 30. More preferably, a visual indicator 27 (e.g. such as a large arrow) is provided on the pin actuator 26*a* to provide a clear visual signal to an operator of the injector as to where along the injectors longitudinal axis L the actuator is located. Even more preferably, indicators 29 are provided at the position of each retaining member 22 to provide a clear visual signal to an operator of the injector as to which retaining member 22 the pin actuator 26*a* is about to release or open (e.g. numbering each retaining member with a plate showing a large number).

Preferably, remote actuatable power means 28 is provided to actuate lock actuator system 26 is provided to selectively pull back desired pins 24*p*. In the preferred embodiment, power means 28 comprises a leadscrew 28*l* mounted substantially parallel with the longitudinal axis L of the injector 10, a motor 28*m* to drive the leadscrew 28*l* and a nut 28*n* mounted on the pin actuator 28*a* to receive and treadably mate with the leadscrew 28*l* (leadscrew 28*l* otherwise passing through pin actuator 26*a*) and to translate the torque of the leadscrew 28*l* into linear motive force on the pin actuator 26*a*. The motor 28*m* may be an electric, hydraulic, air or any other suitable type of motor. The pin actuator 26*a* is thereby movable along the longitudinal axis L of the injector upon actuation of the power means 28. Advantageously, the leadscrew-based power means 28 is self-locking (i.e. when stopped, a linear force on the nut 28*n* will not apply a torque to the leadscrew 28*l*). More advantageously, the power means 28 is therefore capable of holding vertical loads (such as the pin actuator 26*a*) when the motor 28*m* is turned off, thereby allowing an operator of the injector 10 to decide when to actuate the power means 28 again so as to have the pin actuator 26*a* pull the next pin 24*p*.

Preferably a control panel (not shown) is provided to control the various components of the injector 10, such as the motor 24*m* that drives the lead screw 28 and the motors 32*m*, 34*m* that drive the upper and lower valves 32, 34. Various sensors, such as proximity sensor 25 as well as other sensors (e.g. associated with positioning of the valves 32, 34 or to measure pressure in the wellhead assembly) may likewise provide sensory input and data to such control panel.

Preferred Method of Operation:

As can now be appreciated, during operation of the preferred embodiment of the injector 10, all retaining members 22 can initially be placed in the closed position (with retaining member locks 24 holding said members 22 in said closed position). Balls 12 of desired number and diameter can then be placed on the retaining members 22. For example, with the ball sizes increasing in diameter when going from the bottom end 11*b* to the top end 11*t*; i.e. the bottom most retaining member 22 within the injector 10 supports the smallest diameter ball 12, while the top most retaining member 22 supports the largest diameter ball, see FIG. 2*a*.

To launch balls 12, the ball 12' closes to the wellhead assembly 30 must be released first, followed by the next closest ball 12". In the preferred embodiment pin actuator 26*a* is positioned near the bottom end 11*b*, below the first pin 24*p*' (see FIG. 2*a*). Lock actuator system 26 is engaged/actuated (preferably via power means 28, e.g. by having motor 28*m* turn lead screw 28*l*) to move pin actuator 26*a* so as to pull back the first pin 24*p*' (see FIG. 2*b*). The retaining member 22' associated with that pin 24*p*' will then pivot (at point 22*p*') towards the open position (e.g. due to gravity); see FIG. 2*c*. The ball 12' that was previously retained by retaining member 22' will now be free to fall towards the bottom end 11*b*, for subsequent exit out of the injector 10 and into the wellhead assembly 30 (such as via connector 11*c*). Lower valve 34 of the wellhead assembly 30 is preferably closed (to contain any wellbore pressures within the wellhead H and wellbore B only), any pressure in staging assembly 36 is bled off so that staging assembly 36 is at atmospheric pressure (e.g. through access port 36*p* and bleed off line BL) and then upper valve 32 is opened to allow passage of ball 12' therethrough (via passage P of upper valve 32) into the staging assembly 36 (see FIG. 2*d*). Upper valve 32 and any open access ports 36*p* are then closed, lower valve 34 is then opened and wellbore pressure is provided to, and held by, staging assembly 36. Once lower valve 34 is opened, ball 12' will drop into the wellhead W (and subsequently the wellbore B to complete its desired operation therein), see FIG. 2*e*. If desired, fluid may be pumped through fluid line FL and an access port 36*p* into the staging assembly 36 to further assist with moving ball 12' down into the wellhead H and wellbore B.

Pin actuator 26*a* is then actuated to move to the next pin 24*p*" and the process is repeated to drop the next ball 12" (see FIG. 2*f*); with upper and lower valves 32, 34, along with access ports 36 and bleed off line BL, being utilized appropriately to manage wellhead pressures within the staging assembly 36. Pin actuator 26*a* can continue to be moved upward along the injector 10 to cause more retaining members 22 to be released to the open position (see FIG. 2*g*). Advantageously, because retaining members 22 are all pivotally mounted to the same side wall 11*w*, and because the interior 10*i* is of such suitable dimensions, once released these members 22 will lay substantially flat on top of one another (in a substantially vertical manner parallel to the longitudinal axis L), thereby no longer interfering with the movement of balls 12 along the interior 10*i* (see FIG. 2*g*).

Embodiments of the invention are discussed herein in the context of the actuation of a series of packers within a wellbore for isolating subsequent zones within the formation for fracturing of the zones. A series of packers typically use a series of different sized balls for sequential blocking of adjacent packers. However, one of skill in the art would appreciate that the invention is applicable to any operation requiring the dropping of one or more balls (whether same-sized or different sized) into the wellbore.

The embodiments of the invention in which an exclusive property or privilege is being claimed are defined as follows:

1. A method for releasing one or more objects into a wellbore of a well, the method comprising:

providing an object injecting apparatus to selectively present the one or more objects to the wellbore, the object injecting apparatus having a body with an interior for housing the one or more objects, the interior comprising at least two axially aligned chambers that surround and support the one or more objects to stage the one or more objects in a predetermined position prior to injection into the well via an object retaining and release mechanism having a plurality of retaining members pivotally mounted to an inside side wall of the body, each of the retaining members capable of pivoting between a blocking position and a release position, and a plurality of retaining member locks to selectively keep the plurality of retaining members in the blocking position and selectively release the one or more objects;

providing a wellhead assembly between the well and the object injecting apparatus;

wherein the wellhead assembly contains any wellbore pressures within the wellbore, receives one or more of the one or more objects from the object injecting apparatus, and selectively releases the one or more of the one or more objects into the wellbore: and wherein a pressure within the chambers of the object injecting apparatus is maintained at a pressure below the wellbore pressures when the one or more objects are ejected from the interior of the housing.

2. The method of claim 1 wherein the object injecting apparatus comprises:

at least one window in the body operable to provide for placement and removal of the one or more objects into and out of the interior of the body;

an opening in the body, the opening being sized to allow the one or more objects to exit the interior; and the object retaining and release mechanism operable to retain and selectively release the one or more objects from the interior of the body out through the opening, the object retaining and release mechanism separately and individually retaining and releasing the one or more objects;

wherein the interior of the body is maintained at a pressure less than an operating pressure of the well.

3. The method of claim 1, further comprising keeping the interior of the body open to atmospheric pressure and the one or more objects are not exposed to higher than atmospheric pressure until after exiting the object injecting apparatus.

4. The method of claim 1, wherein the one or more objects are one or more balls.

5. A method for releasing actuating devices into a well, the method comprising:

providing an actuating device injecting apparatus having a body with an interior capable of housing one or more actuating devices, the interior having at least two axially aligned chambers that support the one or more actuating devices;

supporting the one or more actuating devices within the interior of the body with a retaining and release mechanism having a plurality of retaining members pivotally mounted to an inside side wall of the body, each of the retaining members capable of pivoting between a blocking position and a release position, and a plurality of retaining member locks to selectively keep the plurality of retaining members in the blocking position and selectively release the one or more actuating devices from the interior of the body; and selectively releasing one of the one or more actuating devices with the retaining and release mechanism so that the one of the one or more actuating devices passes through an opening in the body to exit the interior of the body and drop into the well, wherein a pressure of the one or more chambers of the interior of the body is continuously maintained at a pressure less than an operating pressure of the well while the one or more actuating devices drop into the well and while the one or more actuating devices are ejected from the interior of the housing.

6. The method of claim 5, wherein a wellhead assembly is located between the actuating device injecting apparatus and a wellhead of the well, the wellhead assembly having a first pressure control device, a second pressure control device, and a staging assembly positioned between the first pressure control device and the second pressure control device, and wherein the method further comprises passing the one of the one or more actuating devices through the first pressure control device, then passing the one of the one or more actuating devices through the second pressure control device, before dropping the one of the one or more actuating devices into the well.

7. The method of claim 6, further comprising increasing a pressure of the staging assembly before passing the one of the one or more actuating devices through the second pressure control device.

8. The method of claim 7, further comprising equalizing the pressure of the staging assembly with the pressure of the interior of the body before passing the one of the one or more actuating devices through the first pressure control device, and wherein increasing the pressure of the staging assembly before passing the one of the one or more actuating devices through the second pressure control device includes equalizing the pressure of the staging assembly with the operating pressure of the well.

9. A method for releasing actuating devices into a well, the method comprising:

providing an actuating device injecting apparatus having a body with an interior capable of housing one or more actuating devices, the interior comprising a cavity that substantially surrounds the one or more actuating devices, the cavity comprising at least two axially aligned chambers to support the one or more actuating devices, wherein a wellhead assembly is located between the actuating device injecting apparatus and the wellhead, the wellhead assembly having a first pressure control device, a second pressure control device, and a staging assembly positioned between the first pressure control device and the second pressure control device;

supporting the one or more actuating devices within the interior of the body with a retaining and release mechanism having a plurality of retaining members pivotally mounted to an inside side wall of the body, each of the retaining members capable of pivoting between a blocking position and a release position, and a plurality of retaining member locks to selectively keep the plurality of retaining members in the blocking position and selectively release the one or more frac actuating devices from the interior of the body;

selectively releasing one of the one or more actuating devices with the retaining and release mechanism so that the one of the one or more actuating devices passes through an opening in the body to exit the cavity and drop into the well, wherein a pressure of the cavity is continuously maintained at a pressure less than an operating pressure of the well when the one or more actuating devices are ejected from the cavity;

passing the one of the one or more actuating devices through the first pressure control device, then passing the one of the one or more actuating devices through the second pressure control device, before dropping the one of the one or more actuating devices into the well; and increasing a pressure of the staging assembly before passing the one of the one or more actuating devices through the second pressure control device.

* * * * *